United States Patent [19]

Cornelis et al.

[11] 4,343,102

[45] Aug. 10, 1982

[54] METHOD FOR CONTROLLING THE OPERATION OF A DREDGING APPARATUS

[75] Inventors: Christiaan A. Cornelis, Papendrecht; Cornelis De Keizer, Dordrecht, both of Netherlands

[73] Assignee: IHC Holland N.V., Papendrecht, Netherlands

[21] Appl. No.: 147,758

[22] Filed: May 8, 1980

[30] Foreign Application Priority Data

May 10, 1979 [NL] Netherlands ..... 7903679

[51] Int. Cl.[3] ..... E02F 3/88

[52] U.S. Cl. ..... 37/195; 37/64

[58] Field of Search ..... 37/54, 58, 67, 195, 37/DIG. 1; 299/1

[56] References Cited

U.S. PATENT DOCUMENTS

| | | | |
|---|---|---|---|
| 3,380,179 | 4/1968 | Schmidt | 37/67 X |
| 3,470,635 | 10/1969 | Langner et al. | 299/1 X |
| 3,922,015 | 11/1975 | Poundstone | 299/1 |
| 4,008,921 | 2/1977 | Czauderna et al. | 299/1 |

FOREIGN PATENT DOCUMENTS

| | | | |
|---|---|---|---|
| 974336 | 11/1960 | Fed. Rep. of Germany . | |
| 1658028 | 4/1971 | Fed. Rep. of Germany . | |
| 2557221 | 7/1977 | Fed. Rep. of Germany | 299/1 |
| 253962 | 7/1962 | Netherlands . | |
| 6607591 | 12/1967 | Netherlands . | |
| 6712405 | 5/1968 | Netherlands . | |
| 7701257 | 8/1978 | Netherlands | 37/DIG. 1 |
| 1130436 | 10/1968 | United Kingdom | 37/58 |
| 1383756 | 2/1975 | United Kingdom | 299/1 |
| 540990 | 12/1976 | U.S.S.R. | 37/DIG. 1 |

OTHER PUBLICATIONS

Schmitz, "Automatisieren von Ruckladegeraten beim Umschlag von Massenguttern", *Siemens Periodical*, vol. 49, No. 3, 1975, pp. 140–144.

VDI-Zeitschrift, vol. 101, No. 35, Dec. 11, 1959, Dusseldorf (DE) pp. 1691–1696.

*Primary Examiner*—Clifford D. Crowder

*Attorney, Agent, or Firm*—Young & Thompson

[57] ABSTRACT

A method for controlling the operation of a dredging apparatus provided with a cutting tool according to changes in at least one parameter such as soil resistance, comprises performing a working stroke with the cutting tool, measuring that parameter during that one stroke, recording the measured parameter as a function of the distance covered during that one working stroke, and regulating the hauling speed during the following working stroke according to that function. In this way, maximum permissible hauling speed can be achieved without overloading.

5 Claims, 8 Drawing Figures

METHOD FOR CONTROLLING THE OPERATION OF A DREDGING APPARATUS

Figure 1:
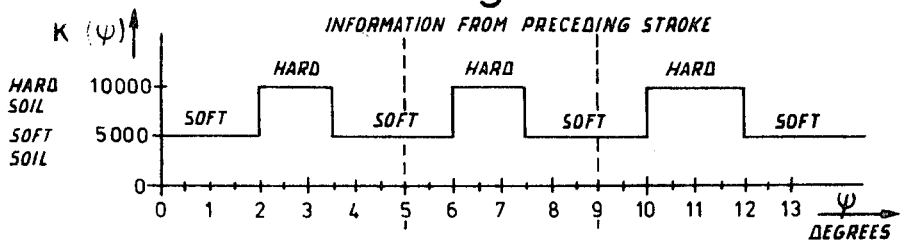

The invention relates to a method for controlling the operation of a dredging apparatus provided with a cutting tool, according to changes in one or more service conditions such as the soil resistance, by control of the hauling speed of the dredging apparatus. A similar method is generally known. When the resistance of the soil changes slowly the control of the hauling speed does not constitute any problem because such changes may be accommodated by adjusting the drive of the cutter head and/or the drive of the winches, such as the side winches in the case of a suction dredge.

Of course it is desirable to achieve a productivity as high as possible and as constant as possible. Naturally no overloading of the drive of the cutter and of the winches, respectively may occur. However the danger of overloading is quite substantial when operating close to the overloading limit in order to reach a high productivity and then suddenly encountering a soil portion which is considerably harder to penetrate. A jamming of the cutter and a stalling of the drive may then occur thus very unfavorably affecting the continuity of the dredging process and consequently the productivity thereof.

This situation does not only occur in the case of suction dredges generally performing a swinging motion around a spud, but also in the case of suction wheel excavators and bucket excavators, respectively, in which the forward drive is of a greater importance.

The object of the invention is now to provide a method not subject to the above drawbacks and allowing a continuous performance of the operation.

In accordance with the invention this object is attained in that during one or more working strokes at least the course of one of these conditions, such as the soil resistance or the concentration of the mixture, is measured and recorded as a function of the distance covered during said working stroke, whereupon said function is utilized for regulating the hauling speed during the following working stroke or strokes. The invention is based additionally on the consideration that during the following working stroke sudden changes in the soil resistance will occur at about the same position within the working stroke as in the preceding stroke. Starting from the information obtained from the preceding stroke one may regulate the working stroke by timely decreasing the hauling speed.

As the measure of the soil resistance one may use the quotient of the cutting resistance and the hauling speed, said quotient being recorded as the function of the covered distance.

This cutting resistance may be determined in many ways for instance by measuring the couple on the rotary cutting tool, by measuring the pulling force on the hauling winch or (which amounts to the same by measuring the driving couple of the winch, etc. Moreover the productivity may be kept at a maximum when determining the maximum admissible hauling speed in that the maximum admissible driving couple of the cutter or the maximum admissible pulling force of the hauling winch is divided by the soil resistance measured during a preceding stroke.

Instead of the cutting resistance one may also take the concentration in the conduit and use the same in an analogous way for determining the maximum admissible hauling speed while thus avoiding too high a concentration.

By measuring during each working stroke and recording these measurements as a function of the distance covered one may govern each following stroke in a way not or hardly deviating from the situation during the preceding stroke.

The measure used as the soil resistance may thus be the quotient of the couple on the cutter and the hauling speed which may be expressed in the following relation $$K = M/V_c$$

in which K = the soil resistance

M = the couple and $V_c$ = the hauling speed of the cutter.

This factor may be recorded as a function of the location of the cutter, for instance as a function of the angle of swinging ($\phi$) in accordance with the relation:

$$K(\phi) = M(\phi)/V_c(\phi) \quad (1)$$

The maximum admissible hauling speed may now be calculated by dividing the maximum admissible couple $M_{max}$ by the soil resistance K ($\phi$) to be expected in accordance with the relation $$V_{c\text{-}max}(\phi) = M_{max}/K(\phi) \quad (2)$$

If the maximum hauling speed is lower than the momentary speed and if an adjustment of this maximum hauling speed some degree in advance of the angle measured during the preceding stroke is provided for then any overloading is prevented with certainty.

In principle the preceding measures may be used for any dredging apparatus. If the angle of rotation cannot be used as the measure of the distance covered, other localisation systems may be utilized for instance in case of a bucket dredge, such as for instance the length of a veering winch rope, the position with respect to beacons etc.

A possible measure for measuring the soil resistance is the couple in the drive of the cutter. Likewise it is conceivable to use to that effect the load of the winch motor for hauling the apparatus. Furthermore one may take forces acting on several parts, such as on the ladder and in the case of a bucket dredge also the pulling force in the bow rope.

Sometimes the governing of the hauling speed based on data from the preceding stroke may lead to too high a velocity for instance in case of meeting the harder layer at a later time than in the preceding stroke. In accordance with the invention this may be obviated in that the stepwise increase of the hauling speed only part of the increase resulting from the preceding stroke is effected every time.

The invention will now be described in detail with respect to the diagrams shown in the FIGS. 1–4, inclusive.

Figure 2:
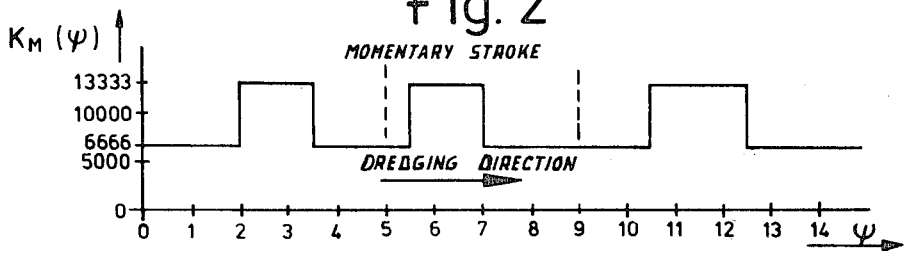

In FIGS. 1 and 2 there have been indicated the values of the soil resistance vs. the angle of swinging of the cutter for two succeeding working strokes.

In FIGS. 3*a*, 3*b*, 3*c*, 4*a*, 4*b* and 4*c* there have been indicated the hauling speeds that may be calculated therefrom.

Besides being proportional to the soil resistance the couple on the cutting tool or on the side winch is also proportional to the magnitude of the forward step and the dredging depth and depth of cut, respectively.

Where these dimensions do not have to remain the same in any further stroke these differences may also be incorporated in the determination of the maximum hauling speed. The depth of cut may be determined on the basis of the forward step of the dredging barge and the extent to which the cutting tool enters the soil to a greater depth.

With reference to an example it will be demonstrated moreover that the effect of a changing depth of cut may also be compensated by means of the quotient of relation (1).

Relation (1) supplies the soil resistance during the preceding stroke. FIG. 1 diagrammatically shows the resistance which changes during the rotary movement. During the momentary stroke the momentary resistance $K_m(\phi)$ is determined again in accordance with relation (1) (see FIG. 2). Due to the difference in for example the depth of cut K ($\phi$) deviates from $K_m(\phi)$. A fixed relation between $K(\phi)$ and $K_m(\phi)$ will however exist because the depth of cut will not be changed materially during the stroke. The maximum admissible hauling speed whereat an overloading will be prevented may now be computed by taking in consideration the relation existing between $K(\phi)$ and $K_m(\phi)$. This may for example take the following form (relation 3):

$$V'_{c\text{-}max}(\phi)=\{M_{max}/K(\phi+1)\}\times\{K(\phi)/K_m(\phi)\} \quad (3)$$

wherein $V'_{c\text{-}max}(\phi)$ is the maximum speed which has to be adjusted at the angle $\phi$ in order to attain no overloading at the angle $\phi+1$.

If it is assumed that the value of K and $K_m$ is determined to a correctness of ½° the following stylized example may be given (FIGS. 1-3 inclusive).

In this example the couple of the cutter is measured by measuring the cutter current of an electric cutter drive while the hydraulic pressure will be measured of a hydraulic drive.

In FIGS. 1 and 2 there applies:

$$K(0°)=K(1°)=5000$$

$$K_m(0°)=6666.$$

The difference between K and $K_m$ is caused by a difference in the depth of cuts. Furthermore in this example there applies a maximum cutter current of 1000 A (hence $M_{max}=1000$).

Consequently it follows from relation (3) that as the maximum hauling speed there will apply:

$$V_{c\text{-}max}(0)=(1000/5000)\times(5000/6666)=0{,}15 \text{ m/sec.}$$

When using relation (3) for each half degree one acquires FIG. 3.

Figures 3A, 3B, 3C:
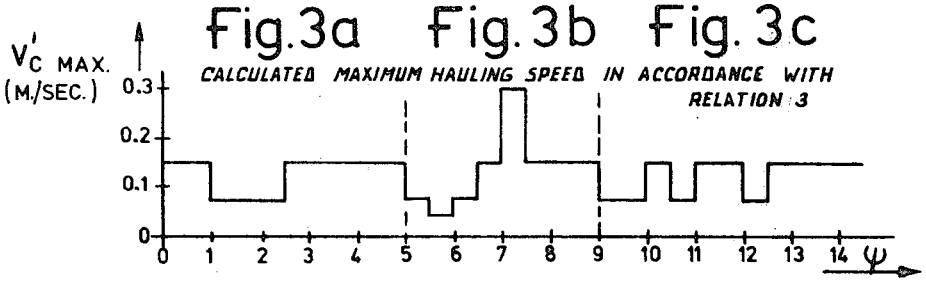

From FIG. 3*a* it is apparent that if the harder type of soil occurs at the same angle $\phi$ as in the preceding stroke the maximum speed is lowered with one degree before landing in the harder type of soil.

Moreover it is apparent that the speed is already increased by one degree before reaching the end of the harder soil layer.

However at that moment the hauling speed will not be increased further in view of the monitoring of the cutter stream where the cutter stream is already at the maximum. Hence the above described adjustment serves only for a timely decrease of the hauling speed.

As indicated in FIG. 3*b* the harder soil layer is reached earlier than in the preceding stroke and from FIG. 3*b* it is apparent that the hauling speed is then additionally lowered first of all which will not be of any harm although at a angle of 7° the maximum hauling speed will be computed too high.

Figures 4A, 4B, 4C:
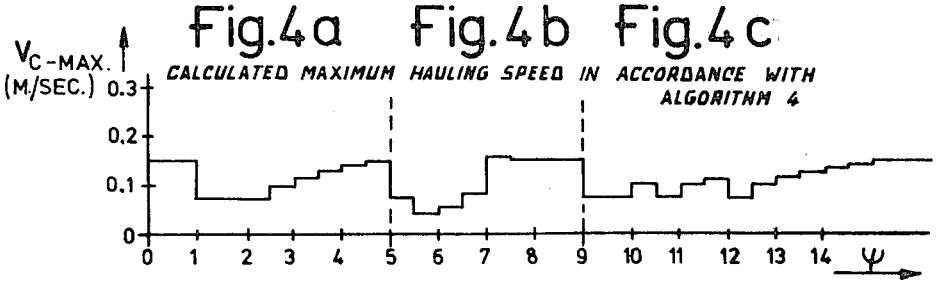

Another problem will arise if the harder soil layer is reached at a later time than in the preceding stroke. From FIG. 3*c* it will then be apparent that the hauling speed at the angle of 10° is increased unduly so that again an overloading may occur. Both problems may be prevented by gradually adjusting to the maximum hauling speed. This may for example be attained by accepting only part of the increase upon increasing hauling speed, for example by accepting only 30% of the increase. Consequently there will be originated the following algorithm:

$$V'_{c\text{-}max}(\phi) = \{M_{max}/K(\phi+1)\} * \{K(\phi)/K_m(\phi)\} \quad (4)$$

if $V'_{c\text{-}max}(\phi) < V_{max}(\phi - \frac{1}{2})$ then there will apply $V_{c\text{-}max}(\phi) = V_{c\text{-}max}(\phi - \frac{1}{2})$ if $V'_{c\text{-}max}(\phi) \geqq V_{c\text{-}max}(\phi - \frac{1}{2})$ then consequently $V_{c\text{-}max}(\phi) = V_{c\text{-}max}(\phi - \frac{1}{2}) + 0.3 \times \{V'_{c\text{-}max}(\phi) - V_{c\text{-}max}(\phi - \frac{1}{2})\}$ On the basis of this algorithm FIG. 4 has been computed in which the speed is regularly well changed in the presented case of an excavated hard soil layer (FIG. 4*b* and 4*c*).

From the above example it will be clear how the information from a preceding stroke may be assimilated for optimally governing the following stroke.

However for the above purpose there are also available other parameters. Hence the same applies to the concentration of the mixture in the suction and the delivery conduit. Such may be expressed in the relation $$K(\phi) = \frac{\text{concentration } (\phi)}{V_c(\phi)}$$

The occurrence of too high a concentration in the conduit may be prevented by replacing $M(\phi)$ in all the above relations by the concentration ($\phi$) and $M_{max}$ by the maximum concentration.

Mutatis mutandis the same applies also for the filling of the buckets in the case of a bucket dredge.

We claim:

1. A method for controlling the operation of a dredging apparatus provided with a cutting tool adapted to perform working strokes on submarine soil, comprising performing a first said working stroke, measuring a parameter of the operation of the dredging apparatus during said first working stroke, recording said measured parameter as a function of the distance covered by the cutting tool during said working stroke, and regulating the hauling speed according to said recorded function during only a second working stroke that immediately follows said first working stroke.

2. A method as claimed in claim 1, in which said parameter is submarine soil resistance.

3. A method as claimed in claim 2, in which said cutting tool is a rotary cutting tool and the measure of soil resistance is the couple acting on the rotary cutting tool.

4. A method as claimed in claim 2, and measuring the pulling force on a hauling winch to determine said resistance.

5. A method as claimed in claim 1, in which said parameter is concentration of material cut by the cutting tool.

* * * * *